US006328112B1

(12) United States Patent
Malone

(10) Patent No.: US 6,328,112 B1
(45) Date of Patent: Dec. 11, 2001

(54) VALVES FOR USE IN WELLS

(75) Inventor: David L. Malone, Sugar Land, TX (US)

(73) Assignee: Schlumberger Technology Corp, Sugar Land, TX (US)

( * ) Notice: Subject to any disclaimer, the term of this patent is extended or adjusted under 35 U.S.C. 154(b) by 0 days.

(21) Appl. No.: 09/243,401

(22) Filed: Feb. 1, 1999

(51) Int. Cl.[7] ..... E21B 34/06

(52) U.S. Cl. ..... 166/386; 166/66.7; 166/332.1; 166/332.6; 251/319

(58) Field of Search ..... 166/386, 373, 166/332.6, 332.1, 66.7, 66.6; 251/193, 194, 195, 319, 326–329; 137/625.26

(56) References Cited

U.S. PATENT DOCUMENTS

| | | | | |
|---|---|---|---|---|
| 2,537,066 | | 1/1951 | Lewis . | |
| 2,723,677 | | 11/1955 | Middleton et al. . | |
| 2,815,925 | | 12/1957 | Fisher, Jr. . | |
| 3,120,267 | * | 2/1964 | Bayless | 166/53 |
| 3,945,606 | * | 3/1976 | McDonald | 251/326 |
| 4,026,517 | * | 5/1977 | Still | 251/214 |
| 4,062,516 | * | 12/1977 | Grove | 251/174 |
| 4,178,964 | * | 12/1979 | Moore et al. | 137/625.4 |
| 4,602,684 | | 7/1986 | Van Wormer et al. . | |
| 4,865,136 | * | 9/1989 | White | 175/227 |
| 4,991,654 | | 2/1991 | Brandell et al. . | |
| 5,156,220 | * | 10/1992 | Forehand et al. | 166/386 |
| 5,186,255 | * | 2/1993 | Corey | 166/250 |
| 5,293,943 | | 3/1994 | Williamson, Jr. . | |
| 5,299,640 | * | 4/1994 | Streich et al. | 166/327 |
| 5,309,993 | | 5/1994 | Coon et al. . | |
| 5,316,084 | | 5/1994 | Murray et al. . | |
| 5,603,385 | | 2/1997 | Colebrook . | |
| 5,727,775 | * | 3/1998 | Rodger | 251/328 |
| 5,927,401 | * | 7/1999 | Morris et al. | 166/64 |
| 6,138,754 | * | 10/2000 | Veneruso et al. | 166/250.03 |

FOREIGN PATENT DOCUMENTS

| | | |
|---|---|---|
| 0 615 054 A | 9/1994 | (EP) . |
| 2 261 719 A | 5/1993 | (GB) . |

* cited by examiner

*Primary Examiner*—Hoang Dang
(74) *Attorney, Agent, or Firm*—Trop, Pruner & Hu PC

(57) ABSTRACT

A valve assembly includes a seat having at least an opening and a first surface. A cover has a contact surface that is slideably and sealingly engaged to the first surface of the seat to form a seal when the contact surface completely covers the at least one opening.

31 Claims, 6 Drawing Sheets

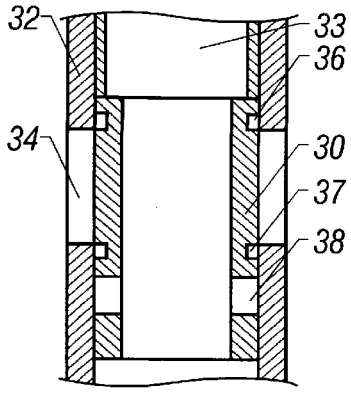
FIG. 1A
(PRIOR ART)
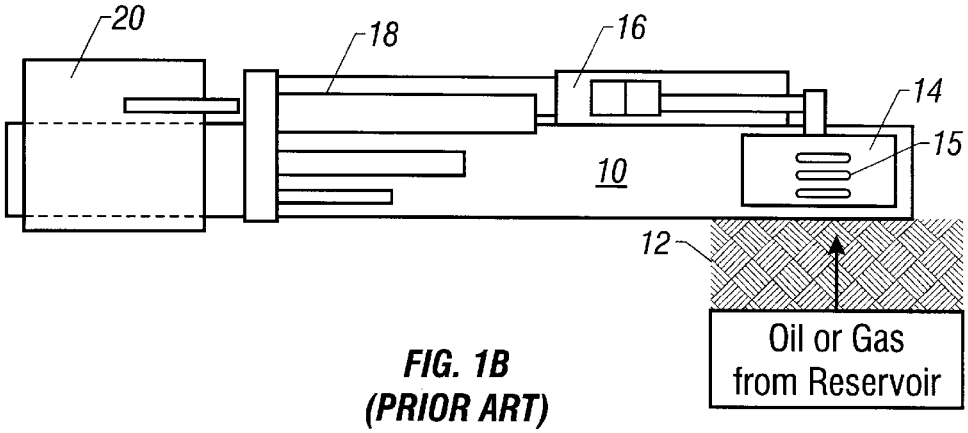
FIG. 1B
(PRIOR ART)
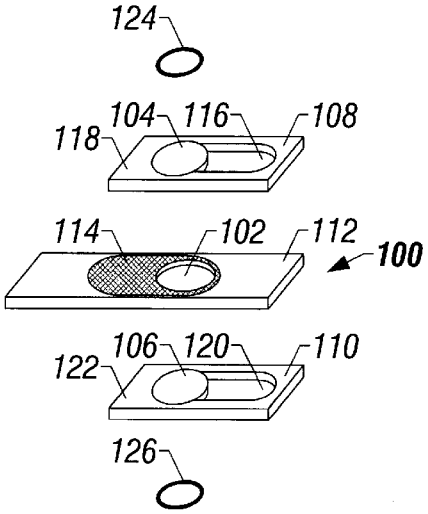
FIG. 2
FIG. 3A
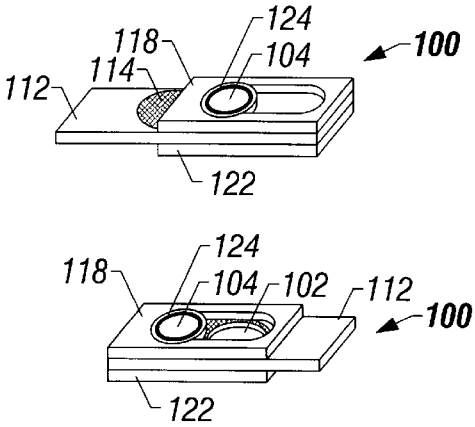
FIG. 3B

VALVES FOR USE IN WELLS

BACKGROUND

The invention relates to valves used to control fluid flow in wells.

In a wellbore, one or more valves may be used to control flow of fluid between different sections of the wellbore. These different sections may include multiple completion zones in vertical or deviated wells or in multilateral wells. Various types of valves are available, including ball valves, sleeve valves, flapper valves and other types of valves.

Conventional sleeve valves are mechanically actuated with a tool lowered into production tubing at the end of a slickline or coiled tubing, for example. To actuate the sleeve valve between open and closed positions, the slickline or coiled tubing is raised or lowered at the well surface. Referring to FIG. 1A, portions of a sleeve valve 30 and production tubing 32 are illustrated. The sleeve valve 30 includes a longitudinally moveable concentric sleeve having a port 38 that when aligned with a corresponding port 34 in the production tubing 32 allows fluid flow between the bore 33 and the exterior of the production tubing 32. As illustrated, when the sleeve valve 30 is in the closed position, the body of the concentric sleeve and O-ring seals 36 and 37 block fluid flow through the production tubing port 33. The seals 36 and 37 typically are made of an elastomer material.

Intervention required to operate such mechanically actuated sleeve valves makes them relatively expensive and time-consuming to operate. Because of the depths of some reservoirs, a long slickline may be needed to run an actuation tool downhole. Further, in horizontal or highly deviated wells, the process of moving the sleeve may be very expensive because of the need for coiled tubing or other more complicated actuating mechanisms to carry the tool to the sliding sleeve. Such problems are exacerbated in a well that uses subsea technology, with no platform over the well, in which case an intervention vessel may be needed to access the sea floor to run a tool downhole to actuate the sleeve valve. Further, after a sleeve valve has been exposed to a wellbore environment for some time, the sleeve may be stuck or rendered more difficult to operate due to corrosion and debris. If the sleeve is stuck, then a mechanical jarring device may have to be run into the production tubing to jar the sleeve loose.

In addition, the hydraulic seals formed of an elastomer material may add additional drag to movement of the sleeve valve, rendering its operation even more difficult. Further, due to the presence of the elastomer seals, reliability may be an issue if the sleeve valve is left downhole for a long period of time due to exposure to caustic fluids.

More recently, remotely actuatable sleeve valve systems have been developed. Referring to FIG. 1B, a remotely actuatable sleeve valve system positioned downstream from a packer 20 is illustrated. As illustrated, the sleeve valve system is positioned adjacent a reservoir 12 in a section of a wellbore. A production tubing 10 may be extended to the reservoir 12, which may contain oil or gas, to receive fluid from the reservoir 12 for production to the surface. A sliding sleeve valve 14, longitudinally moveable between open or closed positions, may be mounted either outside the production tubing 10 as shown in FIG. 1B or inside the production tubing as in FIG. 1A. In the open position, ports 15 of the sleeve valve 14 are aligned to corresponding ports in the production tubing 10.

To operate the sleeve valve 14, it may be coupled to an actuator 16 controlled by an actuator drive system 18, which typically may be a linear actuator. Rotary actuators may also be used. In addition, the actuator 16 may be controlled hydraulically or electrically. In response to remotely transmitted electrical signals or hydraulic actuation, the actuator drive system 18 causes longitudinal movement of the actuator 16.

Sleeve valves may require relatively large forces to overcome the drag from hydraulic seals in the valve, particularly when the sleeve valve is exposed to high pressure. In addition, a sleeve valve may require a relatively long stroke to move between a fully open position and a fully closed position. As a result of the relatively large forces and long strokes employed to actuate a sleeve valve, an actuator (such as the actuator system 18 in FIG. 1B) employed to actuate the sleeve valve may need to be relatively high powered. To provide such high power, sophisticated electronic circuitry may need to be employed and relatively large diameter electrical cables may need to be run from the surface to the valve actuator mechanism.

Thus, a need arises for an improved valve system for downhole use in wells.

SUMMARY

In general, according to one embodiment, a valve assembly includes a seat having at least an opening and a first surface. A cover has a contact surface that is slideably and sealingly engaged to the first surface of the seat to form a seal when the contact surface completely covers the at least one opening.

Other features will become apparent from the following description and from the claims.

BRIEF DESCRIPTION OF THE DRAWINGS

FIGS. 1A and 1B illustrate prior art sleeve valve systems used in a well.

FIGS. 2 and 3A–3B are diagrams of a valve mechanism according to an embodiment of the invention.

DETAILED DESCRIPTION

Figure 4A:
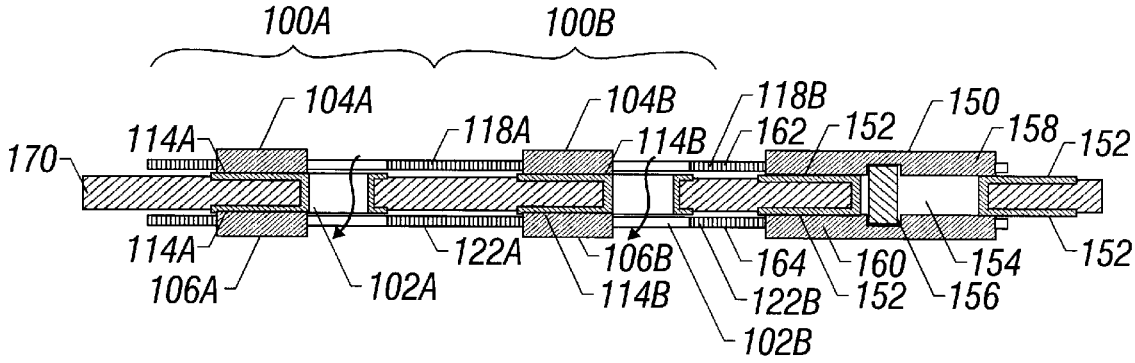
FIGS. 4A–4C are cross-sectional views of a valve system according to an embodiment.

In the following description, numerous details are set forth to provide an understanding of the present invention. However, it is to be understood by those skilled in the art that the present invention may be practiced without these details and that numerous variations or modifications from the described embodiments may be possible.

Referring to FIG. 2, an exploded view of a valve mechanism 100 according to an embodiment of the invention is shown. Basically, the valve mechanism 100 includes a seat (or other support member) 114 having a fluid flow opening or orifice 102 over which an outer disk (or other cover member) 104 and an inner disk (or other cover member) 106 are slideable to form a variable orifice to control fluid flow through the opening 102. The seat 114 is attached to a frame 112, which in one embodiment may be mounted to the housing of a production tubing. In this embodiment, the opening 102 in the seat 114 is aligned with a corresponding opening in the production tubing so that fluid may flow from outside the tubing to the bore of the tubing, and vice versa. In another embodiment, the frame 112 of the valve mechanism 100 may be part of the housing of the production tubing. One feature of the cover member (e.g., disk 104 or 106) according to some embodiments is that it has a width that extends less than the full circumference of the tubing, which is unlike a conventional sliding sleeve in a sleeve valve.

Although reference is made to use of the valve mechanisms with a production tubing, it is to be understood that the invention is not to be limited in this respect. Valve mechanisms according to further embodiments may be used for fluid flow control in other types of tubing, pipes, and various downhole tools and barriers including through-tubing flow. Thus, the term tubing as used in this description has a general meaning and includes pipes, annuluses, mandrels, and the like. In addition, although the illustrated disks 104 and 106 generally have a circular shape, it is contemplated that the disks may have other shapes in other embodiments, including rectangular, square, oval, and so forth. The same may be true also of the opening or orifice 102.

The disks 104 and 106 are adapted to slideably and sealingly engage corresponding surfaces of the seat 114. If the disks 104 and 106 of the valve mechanism 100 fully cover the opening 102, the valve is closed. By sliding the outer and inner disks 104 and 106 over the opening 102 formed in the valve seat 114, the flow area (and hence the flow rate) through the opening may be varied. When the outer disk 104 completely covers the opening 102 in the valve seat 114, flow of fluid is blocked by a face-to-face seal between the bottom face of the disk 104 and the upper face of the seat 114. In effect, the contact or engagement between the bottom face (contact surface) of the disk 104 and the upper face of the seat 114 forms a periphery around which a seal is formed. This seal is enhanced by pressure applied by external well fluids on the top surface of the outer disk 104. Similarly, the inner disk 106 and the seat 114 form a fluid seal when the inner disk 104 completely covers the opening 102 from the other side.

In one embodiment, the disks 104 and 106 (or other cover members) are moved by an actuator to open and closed positions. In other embodiments, the seat 114 may be moved instead of the disks 104 and 106.

The outer disk 104 sits in a slot 116 of a disk carrier 118, and the inner disk 106 sits in a slot 120 of a disk carrier 122. Each of the slots 116 and 120 has an enlarged portion to receive a corresponding one of the disks 104 and 106. The open portions of the slots 116 and 120 line up with the opening 102 to allow fluid flow when the valve is fully or partially open.

A spring washer 124 (which may be in one embodiment a Belleville washer) is placed around a receiving portion of the outer disk 104 to apply a small pre-load force to prevent the outer disk from floating away from the seat 114. Similarly, a spring washer 126 is placed around a receiving portion of the disk 106.

Referring to FIGS. 3A and 3B, the valve mechanism 100 is shown in its fully closed and fully open positions, respectively. According to one embodiment, both the inner and outer disk carriers 118 and 122 are moved together by an actuator mechanism. However, in a different embodiment, the outer and inner disk carriers 118 and 122 may be actuated independently. As shown, the disk carriers 118 and 122 holding the disks 104 and 106 are moved longitudinally relative to the frame 112 holding the valve seat 114.

By using two disks 104 and 106, one on each side of the valve seat 114, pressure integrity may be maintained in the presence of pressure from either direction, e.g., from outside the production tubing or from inside the production tubing. If only one disk were used, for example, if the inner disk 106 were removed, high pressure from inside the production tubing may push the outer disk 104 away from the seat 114, which may reduce the integrity of the seal between the disk 106 and the seat 114. This may result in a leak through the opening 102. Using both the outer and inner disks 104 and 106 as illustrated, a bi-directional valve is provided to seal fluid pressure from either outside the production tubing or inside the tubing.

However, in another embodiment that includes a disk only on one side of the seat 114, a mechanism (such as a pre-load spring) may be coupled to apply sufficient pre-load pressure against the disk so that the disk can maintain a seal even in the presence of pressure that tends to push the disk away from the seat. In addition, although the valve mechanism 100 is described in conjunction with a production tubing, it is to be understood that the valve mechanism according to embodiments of the invention may suitably be used in other systems.

To facilitate the movement of the disks 104, 106 over corresponding surfaces of the valve seat 114, the disks 104, 106 and the seat 114 may be formed of or coated with a material having a low coefficient of friction. Such a material may include polycrystalline-coated diamond (PCD), which may in one configuration have a coefficient of friction ranging from about 0.08 to about 0.15. Other materials that may be used include vapor deposition diamonds, ceramics, silicon nitride, hardened steel, carbides, cobalt-based alloys, or other low friction materials having suitable erosion resistance. The coefficient of friction for carbides and ceramics may range from about 0.11 to 0.2. Other materials having lesser or greater coefficients of friction may also be used.

Other characteristics of materials used to form the disks 104, 106 (or other types of cover members) and the seat 114 (or other type of support member) are that the materials are erosion resistant and have suitable hardness. For example, polycrystalline-coated diamond has a hardness that may range from about 5,000 to 8,000 kg/mm$^2$ (knoops). Certain compositions of carbide and types of ceramic may have a hardness ranging between about 1,300 to 3,200 knoops. With less severe conditions, cobalt-based alloys such as satellite or Cr—B—S—Ni alloys such as colmonoy having a hardness above about 400 knoops may be used. Materials having other hardnesses may also be used.

In one embodiment, the outer and inner disks 104 and 106 and the seat 114 may be formed of a tungsten carbide material that is coated with PCD. In further embodiments, the outer and inner disks 104 and 106 may be formed of other types of materials, e.g., steel, steel alloy, etc. By coating the disks 104, 106 and the seat 114 with a material having a low coefficient of friction, the valve may be opened or closed with reduced force even in the presence of high internal or external pressure acting on the outer or inner disks. Further, the PCD and tungsten carbide materials(or any of the other materials listed above) are erosion resistant, offering significant life improvement over conventional materials in the erosive downhole environment. Corrosive materials that may be produced along with oil and gas may include carbon dioxide, salt, water, $H_2S$, and so forth.

In addition, PCD coated tungsten blanks are commercially available, and therefore manufacturing the valve mechanism according to some embodiments of the invention may be relatively inexpensive. Further, another advantage of a valve system including one or more valve mechanisms according to some embodiments is that the distance traversed by the outer and inner disks 104 and 106 between fully opened and fully closed positions may be relatively small. As a result, a short stroke actuator may be utilized. For example, the stroke to actuate the valve mechanism between fully open and fully closed positions may be about 1.5 inches in one example embodiment. Combining the relatively short stroke and low coefficient of friction materials used to form the valve mechanism according to some embodiments of the invention, a relatively low power actuator may be used to open and close the valve. The power needed to actuate the valve mechanism according to some embodiments may be at least an order of magnitude less than the power needed to operate other remotely actuatable conventional sleeve valves.

Although short strokes to actuate valve mechanisms according to some embodiments may be advantageous in some applications, it is noted that in further embodiments longer strokes may be employed to actuate valve mechanisms.

Figure 4B:
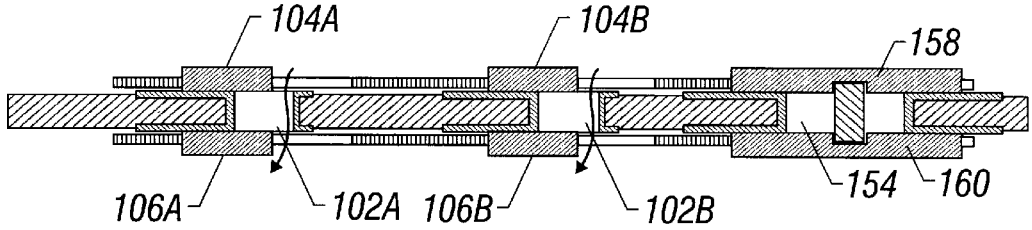
Figure 4C:
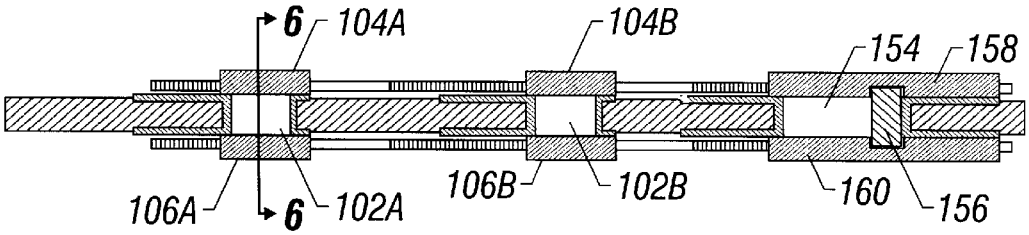

In one example application, to control fluid flow between a reservoir and a production tubing, a valve system includes several of the valve mechanisms 100 illustrated in FIGS. 2 and 3A–3B. Referring to FIGS. 4A–4C, a valve system includes two valve mechanisms 100A and 100B that are operable by an actuator 150. The valve mechanisms 100A and 100B in the illustrated embodiment are linearly coupled to form a linear valve system in which two or more valves may be linearly actuated together.

Figure 5:
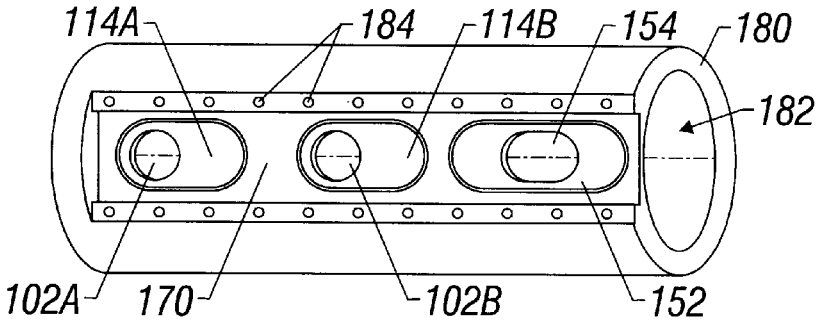
FIG. 5 is a diagram of portions of the valve system of FIGS. 4A–4C mounted on a portion of a production tubing.

Referring further to FIG. 5, the valve system including valve mechanisms 100A, 100B and the actuator 150 may be mounted onto the housing of a production tubing 180. In FIG. 5, portions of the valve mechanisms 100A, 100B and actuator mechanism 150 are not shown, including the inner and outer disks and disk carriers. In the illustrated embodiment, the valve system is formed integrally with a housing portion 170 of the production tubing. In alternative embodiments, the valve system may be attached to the housing of the production tubing 180 using some type of fastener.

The production tubing housing portion 170 is made up of the individual support frames 112A, 112B (FIG. 2) in the valve mechanisms 100A, 100B. As shown in FIG. 5, seats 114A, 114B are attached to the housing portion 170 to receive the outer and inner disks 104A, 104B and 106A, 106B of the valve mechanisms 100A, 100B. As discussed, the outer and inner disks of the valve mechanisms 100A, 100B are moveable over the openings 102A, 102B to provide variable orifices to control fluid flow between the inner bore 182 and the exterior of the production tubing 180.

The embodiment illustrated in FIGS. 4A–4C and 5 includes valve orifices 102A, 102B that are arranged longitudinally along the tubing 180. In other embodiments, the valve orifices may be arranged in a number of different configurations, including the following example arrangements: the orifices are spaced along the circumference of the tubing; the orifices are phased with respect to each other as they travel down the tubing (e.g., a helical or other pattern); and so forth. In addition, although cover members such as disks 104 and 106 in one embodiment are adapted to cover one orifice, other types of cover members may be adapted to cover more than one orifice.

A seat 152 for the actuator mechanism 150 is also attached to the housing portion 170. The seat 152 includes an interconnecting port 154 through which inner and outer actuator covers 160 and 158 of the actuator mechanism 150 may be coupled. The actuator covers 160 and 158 are slideable over the seat 152 in response to actuation by the actuator mechanism 150. To provide low resistance contacts, the actuator covers 160 and 158 and seat 152 may also be coated with PCD layers in one embodiment. Corresponding surfaces of the actuator covers 160 and 158 and the seat 152 form face-to-face seals to prevent fluid from flowing into the port 154.

As shown in FIGS. 4A–4C, the outer actuator cover 158 is coupled to move the outer disk carriers 118A, 118B (of the valve mechanisms 100A, 100B, respectively) longitudinally to adjust the positions of the outer disks 104A, 104B with respect to the openings 102A, 102B of the valve mechanisms 100A, 100B, respectively. Similarly, the inner actuator cover 160 of the actuator mechanism 150 is coupled to move the inner disk carriers 122A, 122B longitudinally.

In one embodiment, the disk carrier 118A may be integrally attached to the disk carrier 118B, which in turn may be integrally attached to a drawer member 162 that is attached to the outer actuator cover 158. Similarly, the disk carrier 122A may be integrally attached to the disk carrier 122B, which in turn may be integrally attached to a drawer member 164 that is coupled to the inner actuator cover 160. Further, the actuator covers 158 and 160 are fixedly attached to each other by a coupling member 156 that is passed through the interconnecting port 154. Space is provided in the interconnecting port 154 to allow the actuator covers 158 and 160 to move longitudinally so that the valve system may be actuated open and closed.

In the illustrated embodiment, because the actuator covers 158 and 160 are fixed to each other by the coupling member 156, they are actuated to move longitudinally together. In an alternative embodiment, the actuator covers 158 and 160 may be separately actuated if the coupling member 156 is removed.

FIG. 4A illustrates the valve system in a fully open position. FIG. 4C illustrates the valve system in a fully closed position. FIG. 4B illustrates the valve system in a partially open position between the fully open and fully closed positions, such as during production of well fluids from the reservoir through the production tubing to the surface. The fluid flow rate through the valve system may be controlled by varying the position of the disks 104A, 104B and 106A, 106B over their respective fluid flow openings 102A, 102B. As shown, the fluid flow openings 102A, 102B are opened and closed together since the disk carriers for the outer and inner disks are attached to each other.

The number of fluid flow openings 102 formed in a valve system according to some embodiments of the invention depends on the total size desired for a flow port in the valve system. An advantage of some embodiments is that each valve mechanism may be made relatively small for ease of manufacture and for reduced cost. To provide a flow port of sufficient size, multiple valve mechanisms 100 may be concatenated.

In an alternative embodiment, rather than being coupled linearly in a sequence, the valve mechanisms may be arranged around the outer radius of the production tubing. Other arrangements of valve mechanisms may also be possible in further embodiments.

Figure 13:
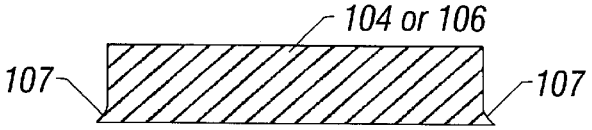
FIG. 13 illustrates a cover member used in the valve mechanism of FIGS. 2 and 3A–3B having a tapered lower edge.

In some embodiments, each disk 104 or 106 may have an angled or tapered slightly protruding lower edge 107 (FIG. 13) that abuts the seat 114 of the valve mechanism. The tapered lower edge 107 is able to rake accumulation or debris from the seat 114 as the disk 104 or 106 is moved over the seat. This may aid in forming a more reliable seal.

Figure 6:
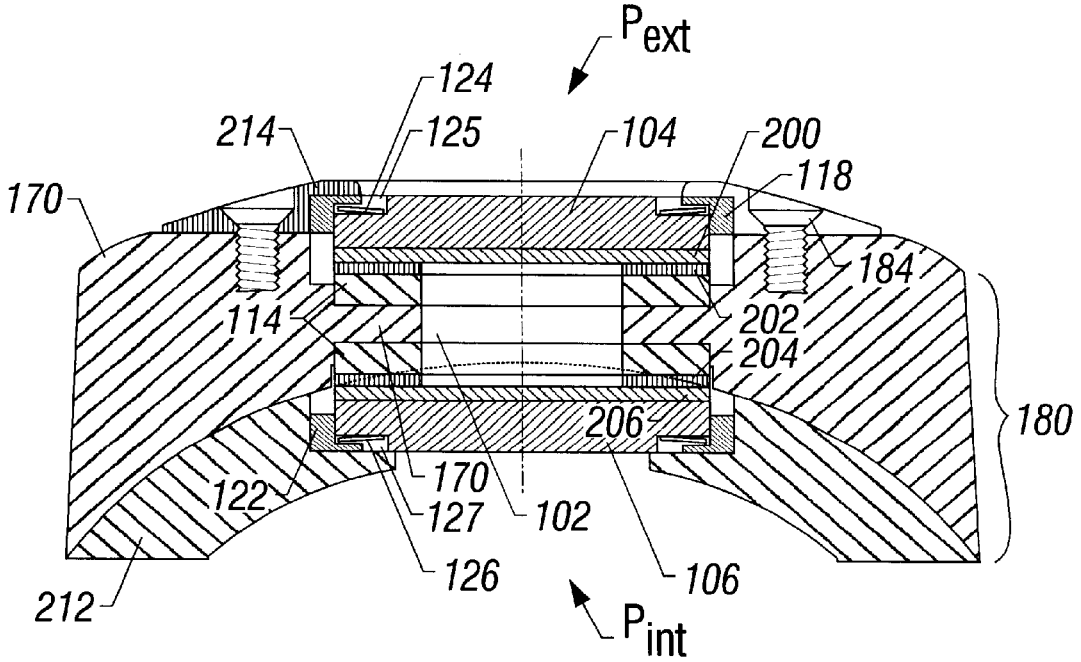
FIG. 6 is a cross-sectional diagram of a portion of the valve system of FIGS. 4A–4C.

Referring to FIG. 6, a cross-sectional diagram of the valve system of FIGS. 4A–4C is illustrated. The outer disk 104 includes a receiving shoulder 125 on which the spring washer 124 may sit. The spring washer 124 is retained against the shoulder 125 by the disk carrier 118, which is held in place by a retainer bracket 214 attached to the housing body 170 of the production tubing 180 by screws 184. As illustrated in FIG. 6, the frame of the valve system may be integrally attached to the housing body 170 of the production tubing 180.

The spring washer 124 applies a force down onto the outer disk 104 to help maintain a tight seal between the outer disk 104 and the seat 114. This is in addition to any force applied against the upper surface of the outer disk 104 by formation fluid pressure $P_{ext}$ from outside the production tubing.

The lower surface of the outer disk 104 may be coated with a layer 200 formed of a material having a low coefficient of friction (e.g., PCD). Similarly, the upper surface of the seat 114 may also be coated with a layer 202 having a low coefficient of friction.

At the inner side of the valve system, the inner disk 206 includes a receiving shoulder 127 on which the spring washer 126 may be placed. The spring washer 126 is held against the shoulder 127 by the disk carrier 122. A sleeve 212 mounted inside the housing body 170 of the production tubing 180 holds the disk carrier 122 in place. The spring washer 126 applies a force against the lower surface of the inner disk 106 to push its upper surface against the lower surface of the seat. Further, any pressure $P_{int}$ inside the production tubing may be applied against the lower surface of the inner disk 106. The spring washer 126 and any internal fluid pressure $P_{int}$ help maintain a relatively reliable fluid seal between the inner disk 106 and the seat 114.

The lower surface of the seat 114 is coated with a layer 204 formed of a material having a low coefficient of friction, which is contacted to a layer 206 also formed of a material having a low coefficient of friction on the upper surface of the inner disk 106. The layers 200, 202, 204, and 206 allow for easier movement of the disks 104, 106 relative to the seat 114 due to the reduced friction contacts.

An actuator mechanism (not shown) coupled to move the actuating mechanism 150 may be an electrical or hydraulic device, depending on the type of system used. A configuration according to one example embodiment may include a linear actuator having an acme thread or ball screw driven by a brushless direct current (DC) or stepper motor. In another embodiment, a hydraulic actuator mechanism may be controlled by fluid pressure applied down the wellbore.

Figure 7:
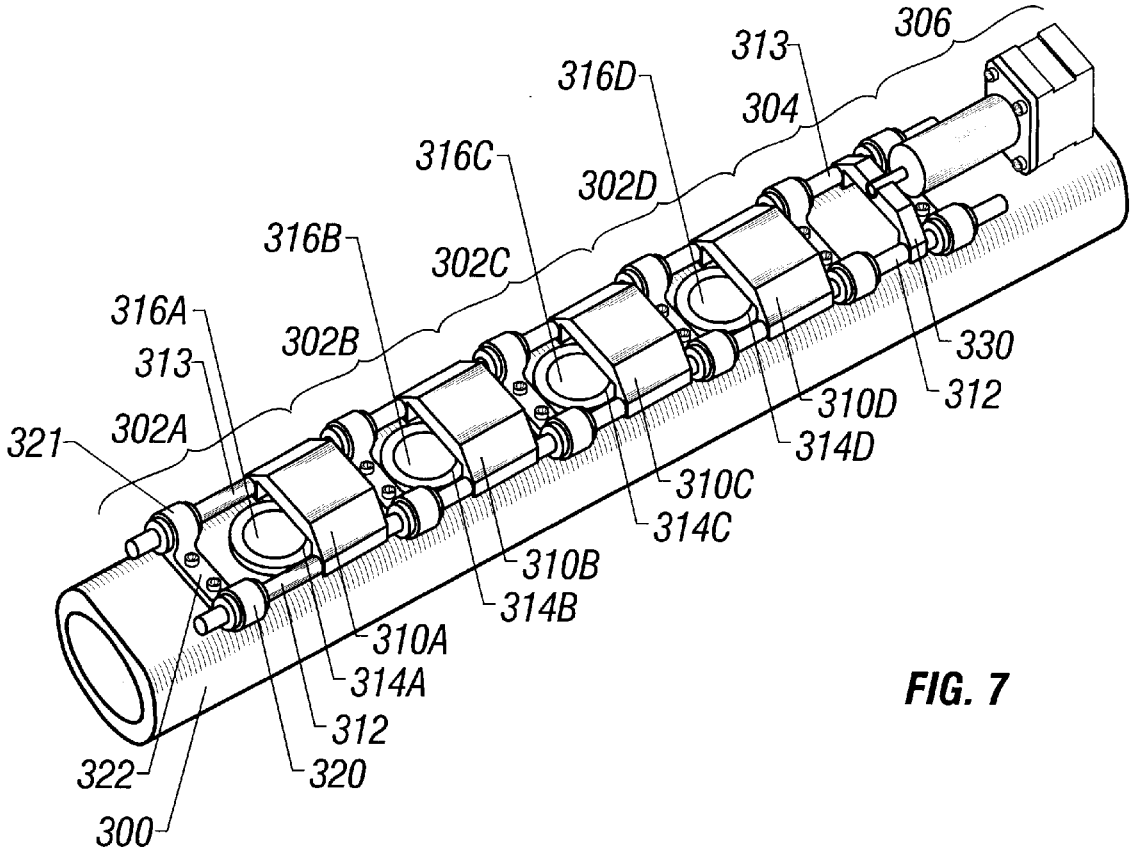
FIG. 7 is a diagram of a valve system according to another embodiment of the invention.

Referring to FIG. 7, a valve system according to another embodiment is attached to a production tubing 300. In this embodiment, four valve mechanisms 302A, 302B, 302C, and 302D are linearly coupled to an actuator mechanism 304. In turn, the actuator mechanism 304 is controlled by a linear actuator 306, which may be either an electrical or a hydraulic actuator.

Each valve mechanism 302 includes a cap 310 attached to a pair of moveable rods 312, 313. The cap 310 is attached to a disk 340 (shown in FIG. 8) or other suitable cover member that is adapted to cover a fluid flow opening 316 defined by a seat 314. The pair of rods 312, 313 are moved longitudinally by the actuator mechanism 304 to move the cap in relation to the opening 316. In this manner, the valve mechanism 302 may be actuated between fully closed, partially open, and fully open positions. As with the embodiments described above, the disks and seats 314 of the valve mechanisms 302 may also be coated with a material having a low coefficient of friction to allow valve actuation with smaller forces.

The pair of rods 312, 313 are passed through a series of linear bushing 320, 321 attached by corresponding brackets 322 to the production tubing 300 housing. In the actuator mechanism 304, a coupling member 330 fixedly attaches rods 312, 313. The coupling member 330 is coupled to a linear actuator 306. By moving the pair of rods 312, 313 longitudinally, the valve mechanisms 302 may be operated.

Figure 8:
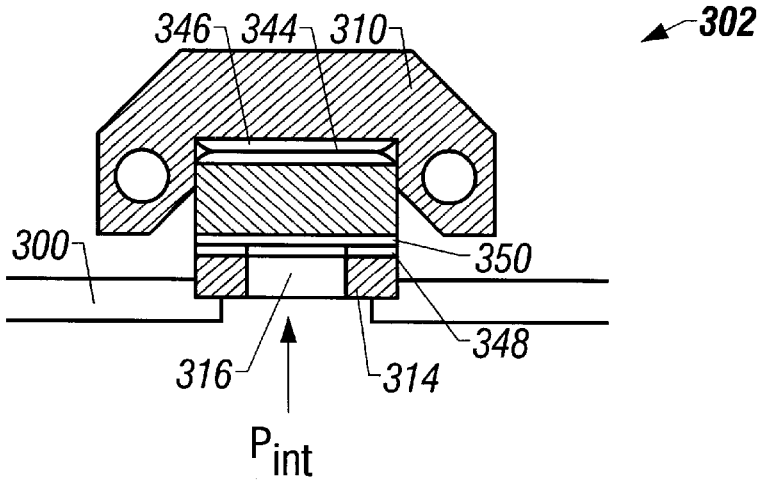
FIG. 8 is a cross-sectional view of a valve mechanism in a closed or partially closed position in the valve system of FIG. 7.

Referring to FIG. 8, a cross-section of one of the valve mechanisms 302 in a closed or partially closed position is illustrated. The seat 314 may be integrally attached to the housing of the production tubing 300 in one embodiment. The upper surface of the seat 314 may be coated with a layer 348 formed of a material having a low coefficient of resistance (e.g., PCD). The lower surface of the disk 340 may also be coated with a layer 350 formed of a material having a low coefficient of friction. The disk 340 is pushed against the seat 314 by a pre-load spring 344, which is located in a region 346 underneath the cap 310. The pre-load spring applies a force $F_{spring}$ against the upper surface of the disk 340 that is designed to be greater than force applied by pressure $P_{int}$ from inside the production tubing 300. The force due to the internal pressure is $P_{int}*A_v$, where $A_v$ is the area of the lower surface of the disk 340 exposed to the opening 316. The force $F_{spring}$ applied by the spring 344 keeps the disk 340 against the seat 314 in the presence of pressure inside the production tubing 300.

If a valve system includes several valve mechanisms 302 according to the FIG. 8 embodiment, the cumulative force applied by the pre-load springs 344 of the several valve mechanisms 302 may be relatively large, which may require an actuator of sufficiently high power. If the use of a high-powered actuator is undesirable, the number of valve mechanisms 302 may be reduced (to one or two, for example) so that a less expensive, lower powered actuator may be included in the valve system.

Figure 10A:
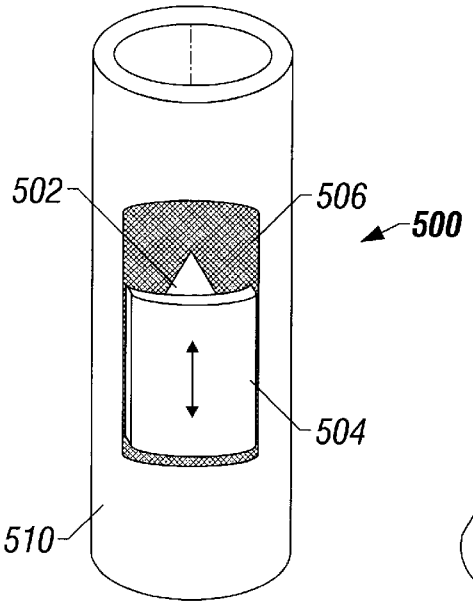
FIGS. 10A–10B, 11, and 12A–12C illustrate further embodiments of valve mechanisms.
Figure 10B:
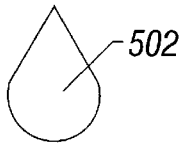

Referring to FIGS. 10A–10B, 11, and 12A–12C, further embodiments of valve mechanisms are illustrated. In FIG. 10A, a valve mechanism 500 includes a cover member 504 that is generally rectangular in shape, with a slight curve to conform to the housing 510 of a tubing or other tool. The cover member 504 is slideably and sealingly engaged to a seat 506 that is attached to or integrated with the housing 510. As illustrated in FIG. 10B, an opening 502 defined by the seat 506 is shaped generally as a tear drop. Alternatively, the opening 502 may be any other number of shapes, e.g., rectangular, square, circular, oval, etc.

Figure 11:
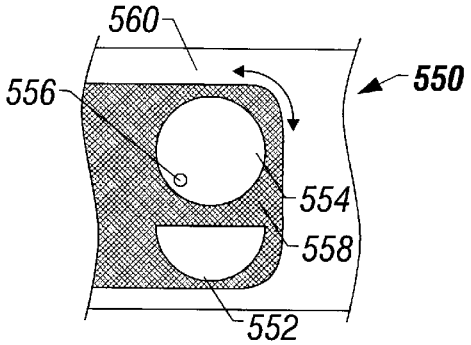

In FIG. 11, a valve mechanism 550 according to another embodiment attached or integrated with the housing 560 of a tubing or other tool 560 includes a cover member 554 that is rotatable about an axis 556. The bottom face of the cover member 554 is slideably and sealingly engaged with a seat 558 so that the cover member 554 may be rotated to partially or completely cover an opening 552. As illustrated, the opening 552 generally has a semi-circular shape, although other shapes are also possible.

Figure 12A:
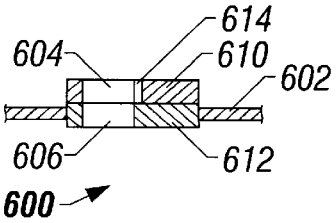
Figure 12B:
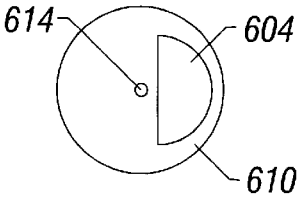
Figure 12C:
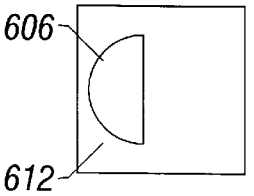

In yet another embodiment, as illustrated in FIGS. 12A–12C, a valve mechanism 600 may have a cover member 610 that is rotatable about an axis 614 and a support member 612 that is attached to or integrated with the housing 602 of a tubing or other tool. Each member 610 or 612 includes an opening 604 or 606, respectively. The cover member 610 is rotatable so that the openings 604 and 606 can line up partially or completely to provide a partially or completely open valve.

In a further alternative embodiment, multiple valve mechanisms in a valve system may be actuated sequentially, with one or more actuated open or closed before others. For example, one valve system may have a first valve mechanism with a smaller orifice than the remaining valve mechanisms. To actuate the valve system to an open position, the first valve mechanism may be actuated to an open position first followed by the rest of the valve mechanisms. This allows pressure inside the tubing or tool to equalize with pressure outside the tubing or tool, thereby making actuation of the remaining valve mechanisms easier as the amount of force applied by the difference in pressure is reduced. To actuate the valve mechanisms at different times, separate actuators may be used. Alternatively, one actuator may be used with some type of lost motion mechanism so that some valve mechanisms may be actuated before others.

Figure 9:
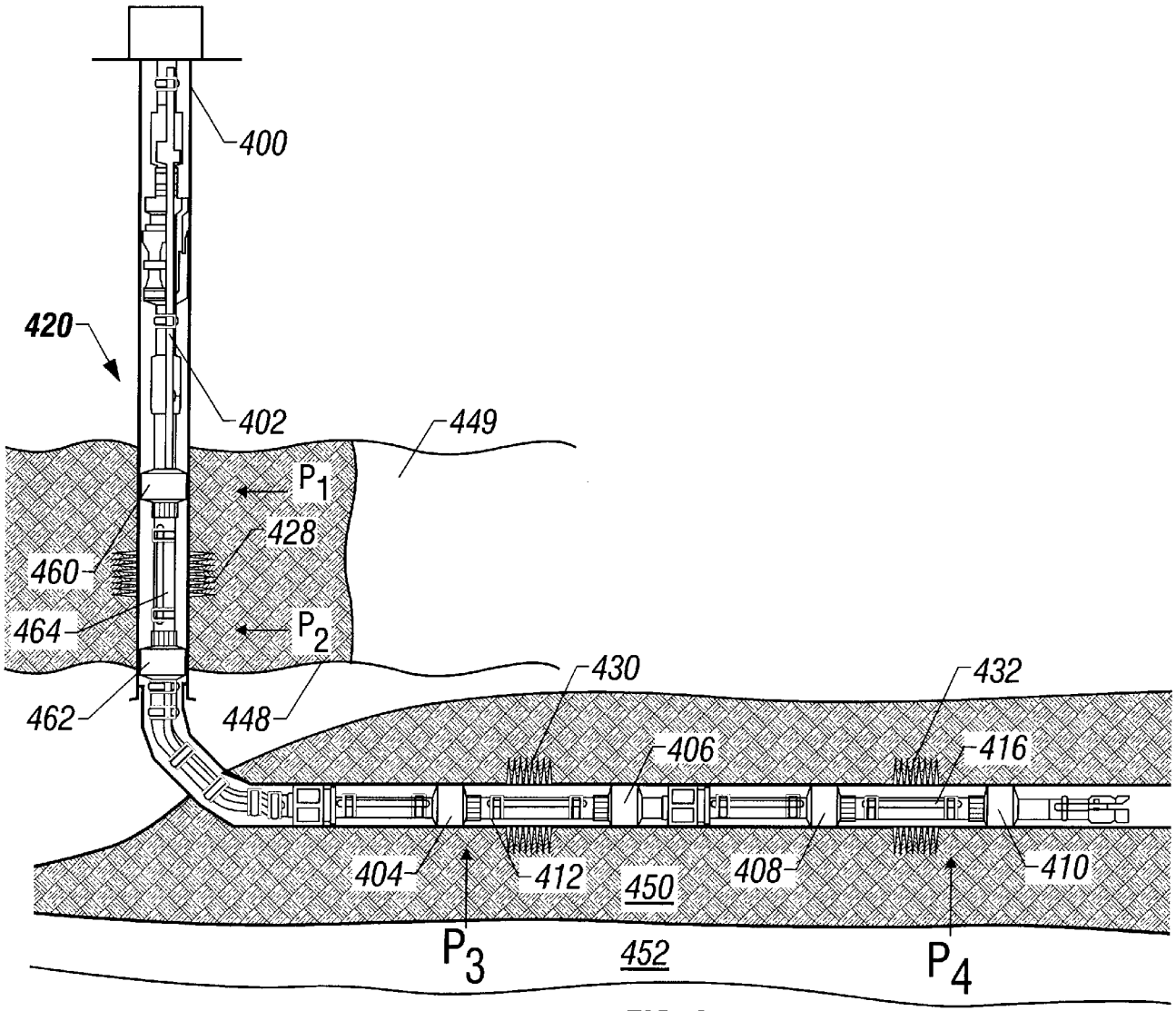
FIG. 9 is a diagram of a completion system positioned in a wellbore capable of employing valve systems according to some embodiments.

Referring to FIG. 9, a wellbore 420 includes various example completion equipment, including casing 400 lining a vertical portion and production tubing 402 extending from the well surface to reservoirs located downhole. The wellbore 420 may be a land well or a subsea well (i.e., located under the bottom surface of the sea) with or without a production platform above the well. As examples, the completion equipment in the wellbore 420 may include an intelligent completion system (ICS), a permanent monitoring system (PMS), or other type system. An ICS may include various sensors, monitoring and measurement devices, and control units positioned downhole to monitor conditions downhole and to take actions in response to those monitored conditions, either automatically or by a command issued at the surface or remotely. A PMS includes various monitoring and measurement devices that communicate downhole conditions to systems located at the surface or remotely.

In the illustrated wellbore 420, several production zones may be located in the vertical and deviated portions of the wellbore, including zones defined between successive packers 460 and 462, packers 404 and 406, and packers 408 and 410. Perforations 428, 430, and 432 may be created in the three illustrated production zones to allow formation fluid to flow from reservoirs 448, 450, and 452 into the production tubing 402 and up to the surface. In the different production zones, valve systems 464, 412, and 416 according to some embodiments may be included to control fluid flow. Thus, for example, in the vertical portion of the wellbore 420, the valve system 464 controls fluid flow into the production tubing 402 from the reservoir 448 through perforations 428. In the deviated portion of the wellbore 420, the valve system 412 controls fluid flow into the production tubing 402 from a reservoir 450 through the perforations 430, and the valve system 416 controls fluid flow into the production tubing 402 from a reservoir 452 through perforations 432.

Production from the reservoirs may occur over long time periods (e.g., months or years). Flow of fluid from the reservoirs into the production tubing depends on formation pressure applied by pressure fronts in each reservoir. Such pressure fronts may be created by a layer of water behind the reservoir, such as the water layer 449 behind the reservoir 448. The pressure front may be relatively uniform initially when the reservoir 448 is relatively full. However, once a reservoir becomes depleted, such formation pressure fronts may become skewed, with formation pressure at one side of the reservoir greater than formation pressure at the other side. For example, in the reservoir 448 adjacent the production zone in the vertical portion of the wellbore 420, once the formation pressure front becomes non-uniform, pressure $P_1$ applied at the upper side of the reservoir may be much smaller than pressure $P_2$ applied at the lower side. This may cause water from the water layer 449, for example, to be produced at the lower side of the reservoir into the production zone.

To counteract this phenomenon, several valve systems according to embodiments of the invention may be placed in the production zone adjacent reservoir 448. As the formation pressure characteristics in the reservoir 448 change, the valve systems may be remotely adjusted to vary their flow rates. For example, the flow rates of the valve systems at the lower side of the production zone may be set lower than flow rates of valve systems at the upper side because of differences in formation pressure. In fact, the lower valve systems in the production zone may be completely shut off.

According to some embodiments, each of the valve systems may be electrically actuatable in response to commands issued by an operator at the well surface or at a remote site. Sensors may be placed in each of the production zones to detect flow characteristics. The sensed information may be communicated to the surface or to a remote site. Using the communicated information, an operator may adjust the valve systems as necessary.

In another example application, the reservoirs 448 and 450 may be produced simultaneously through the production tubing 402. However, typically, different reservoirs may be associated with different formation pressures. Such differences in formation pressures may be significant. To prevent fluid from one zone being forced into another zone due to such differences in formation pressures, valve systems according to embodiments may be adjusted to equalize flow rates such that effective production of formation fluids may be provided to the surface. Again, the valve systems in one embodiment may be adjustable remotely to properly control fluid production.

In addition, in the deviated portion of the wellbore 420, a water table 452 may sit beneath the reservoir 450. Pressure in the reservoir 450 may be applied by the water table 452 upwards to the production tubing 402. However, the applied pressure front may also become non-uniform. For example, pressure $P_3$ applied at one end may become greater than pressure $P_4$ applied at the other end. If the pressure differential becomes great enough, water from the water table 452 may be produced into the production zone defined between packers 404 and 406. To prevent this, the valve systems 412 and 416 in the two zones may be controlled such that fluid production into the zones is equalized.

Valve systems according to embodiments may have numerous applications. For example, in addition to regulating flow of hydrocarbons into the production tubing as described above, the valve systems may also be used to regulate flow of fluids from inside the pipe to the outside for applications such as gas injection regulation, water injection regulation, or other non-oil field applications. Further, the valve systems may be used for such applications as drilling drain holes from a parent well into one or more given reservoirs.

While the invention has been disclosed with respect to a limited number of embodiments, those skilled in the art will appreciate numerous modifications and variations therefrom. It is intended that the appended claims cover all such modifications and variations as fall within the true spirit and scope of the invention.

What is claimed is:

1. A valve for controlling fluid flow through at least one orifice in a wall of a downhole tubing that has a circumference, comprising:

a seat defined about the at least one orifice;

at least one cover selectively positionable at and between an open position and a closed position, the at least one cover slideably and sealingly engaging the seat, the at least one cover extending less than the full circumference of the tubing, wherein:

the wall of the tubing has an interior and an exterior surface;

the seat comprises an inner seat portion defined by the interior surface about the at least one orifice and an outer seat portion defined by the exterior surface about the at least one orifice;

a first cover selectively positionable at and between an open and closed position, the first cover slideably and sealingly engaging the inner seat portion; and a second cover selectively positionable at and between an open and closed position, the second cover slideably and sealingly engaging the outer seat portion.

2. A downhole valve assembly for controlling fluid flow through an orifice defined in a side of a tubing, comprising:

a seat member comprising a first surface defined around the orifice; and a first cover having a contact surface in slideable and sealing engagement with the first surface of the seat member and moveable with respect to the seat member to provide an open and a closed position, the first cover extending less than a full circumference of the tubing, the contact surface of the first cover and the first surface of the seat member cooperable to provide a face-to-face fluid seal, wherein the orifice has a first side and a second side, the first cover being provided on the first side of the orifice, the downhole valve assembly further comprising a second cover on the second side of the orifice.

3. The valve assembly of claim 2, wherein the first cover and seat member each comprises a material having a low coefficient of friction.

4. The valve assembly of claim 3, wherein the material includes polycrystalline-coated diamond.

5. The valve assembly of claim 3, wherein the material is selected from the group consisting of vapor deposition diamond, ceramic, silicon nitride, carbide, and a cobalt-based alloy.

6. The valve assembly of claim 2, wherein the second cover is slideably disposed over the second side of the orifice to provide an open position and a closed position.

7. The valve assembly of claim 6, further comprising a second seat member comprising a second surface defined around the second side of the orifice, the second cover having a contact surface in slideable and sealing engagement with the second surface of the second seat member.

8. A downhole valve for controlling flow through an orifice defined in a wall of a tubular structure, comprising:

a first surface defined about the orifice;

a cover adapted to slide to and between an open position and a closed position, the cover sealably closing the orifice when in the closed position and exposing at least a portion of the orifice when in the open position;

the cover having a contact surface adapted to slideably and sealingly engage the first surface to form a face-to-face fluid seal when the cover is in the closed position; and a spring attached to push the cover contact surface against the first surface.

9. The valve of claim 8, wherein the contact surface engages the first surface along a periphery when the cover is in the closed position, the seal being formed around the periphery.

10. The valve of claim 8, wherein each of the cover contact surface and first surface comprises a material having a low coefficient of friction.

11. The downhole valve of claim 8, wherein the contact surface of the cover is adapted to slide over the first surface between the open position and the closed position.

12. The downhole valve of claim 8, wherein the cover is adapted to be set at an intermediate position between the open position and the closed position to provide a partially open position of the valve.

13. A downhole valve assembly for controlling flow through an opening defined in a first surface, comprising:

a cover member having a contact surface in slideable and sealing engagement with the first surface, the cover member further including a tapered lower edge that is adapted to remove debris from the first surface.

14. The valve assembly of claim 13, wherein the tapered lower edge protrudes outwardly from a side of the cover member.

15. The valve assembly of claim 13 wherein the tapered lower edge has an inclined surface.

16. The valve assembly of claim 13, wherein the tapered lower edge faces in a direction along an axis of movement of the cover member.

17. A valve for controlling fluid flow through at least one orifice in a wall of a downhole tubing that has a circumference, comprising:

a seat defined about the at least one orifice; and at least one cover selectively positionable at and between an open position and a closed position, the at least one cover slideably and sealingly engaging the seat, the at least one cover having a sealing surface that cooperates with a surface of the seat to form a face-to-face fluid seal, the at least one cover extending less than the full circumference of the tubing, wherein the cover sealing surface and the seat surface are adapted to provide the fluid seal without use of a separate sealing element.

18. The valve of claim 17, further comprising a spring element adapted to push the sealing surface of the cover against the seat surface.

19. A downhole valve assembly for controlling fluid flow through an orifice defined in a side of a tubing, comprising:

a seat member comprising a first surface defined around the orifice; and a first cover having a contact surface in slideable and sealing engagement with the first surface of the seat member and moveable with respect to the seat member to provide an open and a closed position, the first cover extending less than a full circumference of the tubing, the contact surface of the first cover and the first surface of the seat member cooperable to provide a face-to-face fluid seal, wherein the contact surface of the first cover and the first surface of the seat member are adapted to provide the fluid seal without a separate sealing element.

20. The valve assembly of claim 19, further comprising a spring element adapted to push the contact surface of the first cover against the first surface of the seat member.

21. A downhole valve assembly for controlling fluid flow through an orifice defined in a side of a tubing, comprising:

a seat member comprising a first surface defined around the orifice; and a first cover having a contact surface in slideable and sealing engagement with the first surface of the seat member and moveable with respect to the seat member to provide an open and a closed position, the first cover extending less than a full circumference of the tubing;

the contact surface of the first cover and the first surface of the seat member cooperable to provide a face-to-face fluid seal; and plural carriers each supporting one of the corresponding covers, the carriers being attached.

22. The valve assembly of claim 21, further comprising an actuator mechanism adapted to move the carriers.

23. A downhole valve assembly for controlling fluid flow through an orifice defined in a side of a tubing, comprising:

a seat member comprising a first surface defined around the orifice; and a first cover having a contact surface in slideable and sealing engagement with the first surface of the seat member and moveable with respect to the seat member to provide an open and a closed position, the first cover extending less than a full circumference of the tubing, the contact surface of the first cover and the first surface of the seat member cooperable to provide a face-to-face fluid seal, wherein the tubing defines at least one other orifice, the valve assembly further comprising at least one other cover adapted to control flow through the at least one other orifice, wherein the first orifice and the at least one other orifice have different flow areas.

24. A method of making a valve assembly for use with a tubing having a wall with an opening, the method comprising:

forming a seat having a first surface definable about the opening in the wall of the tubing;

mounting at least one cover relative to the seat so that the cover is moveable relative to the opening; and forming a contact surface on the cover to slideably and sealingly engage the first surface of the seat to form a face-to-face fluid seal when the contact surface completely covers the opening, wherein forming the face-to-face fluid seal is provided without use of a separate seal element.

25. A valve to control flow through an orifice, comprising:

a first surface on a first side of the orifice and a second surface on a second side of the orifice;

a first cover adapted to slideably and scalingly engage the first surface, the first cover slideable over the first surface; and a second cover adapted to slideably and scalingly engage the second surface, the second cover slideable over the second surface.

26. The valve of claim 25, further comprising a member attaching the first and second covers to enable movement of the first and second covers together.

27. The valve of claim 25, further comprising at least one additional first cover slideable over a first side of at least one other orifice and at least one additional second cover slideable over a second side of the at least one other orifice.

28. A valve assembly comprising:

a first surface defining an orifice;

a cover having a sealing surface adapted to slideably and sealingly engage the first surface to provide an open position and closed position of the valve; and an element adapted to push the cover sealing surface against the first surface to enhance sealing engagement between the cover sealing surface and the first surface.

29. The valve assembly of claim 28, wherein the cover is slideable over the first surface between the open position and the closed position.

30. The valve assembly of claim 28, wherein the element comprises a spring.

31. The valve assembly of claim 28, further comprising an actuator adapted to move the cover between the open and closed position, the actuator further adapted to set the cover at an intermediate position between the open and closed positions.

* * * * *